United States Patent [19]

Metcalf, Sr.

[11] 3,999,037

[45] Dec. 21, 1976

[54] HEATED GARMENT

[75] Inventor: Edward K. Metcalf, Sr., Anchorage, Alaska

[73] Assignee: The Raymond Lee Organization, Inc., New York, N.Y. ; a part interest

[22] Filed: Aug. 18, 1975

[21] Appl. No.: 605,619

[52] U.S. Cl. ..... 219/211; 128/379; 219/527

[51] Int. Cl.[2] ..... H05B 1/00

[58] Field of Search ..... 219/211, 527–529, 219/535; 2/2.1 A; 128/379–382

[56] References Cited

UNITED STATES PATENTS

| | | | |
|---|---|---|---|
| 1,358,509 | 11/1920 | Birkenfeld | 219/211 |
| 2,329,766 | 9/1943 | Jacobsen | 219/211 |
| 3,858,028 | 12/1974 | Kerr | 219/211 |

FOREIGN PATENTS OR APPLICATIONS

| | | | |
|---|---|---|---|
| 546,812 | 7/1942 | United Kingdom | 219/211 |

*Primary Examiner*—C. L. Albritton
*Attorney, Agent, or Firm*—Daniel Jay Tick

[57] ABSTRACT

A vest type garment has a lining consisting of an electrical heating element. A pair of sleeves has a similar lining. A pair of pants has a similar lining. A hat has a similar lining. An energy device supplies electrical energy to the electrical heating element of each of the vest type garment, the pair of sleeves, the pair of pants and the hat for energizing the electrical heating elements to provide heat.

1 Claim, 7 Drawing Figures

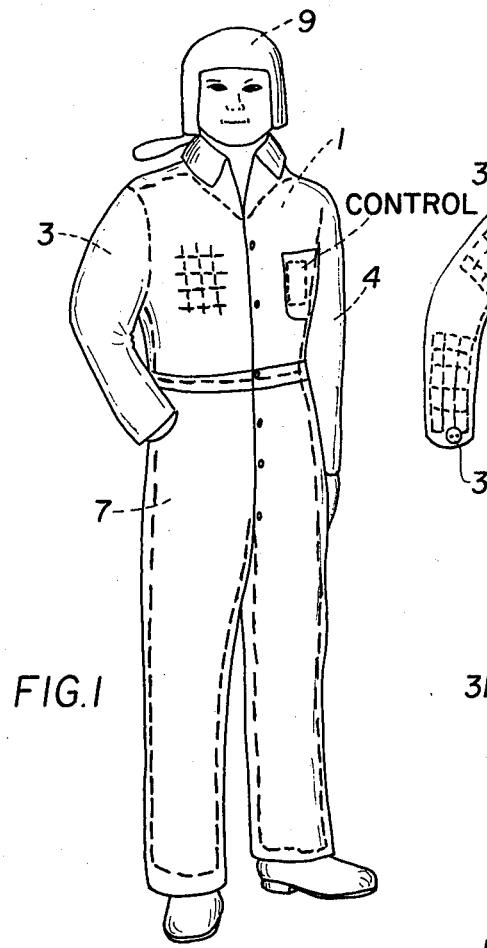
FIG.1
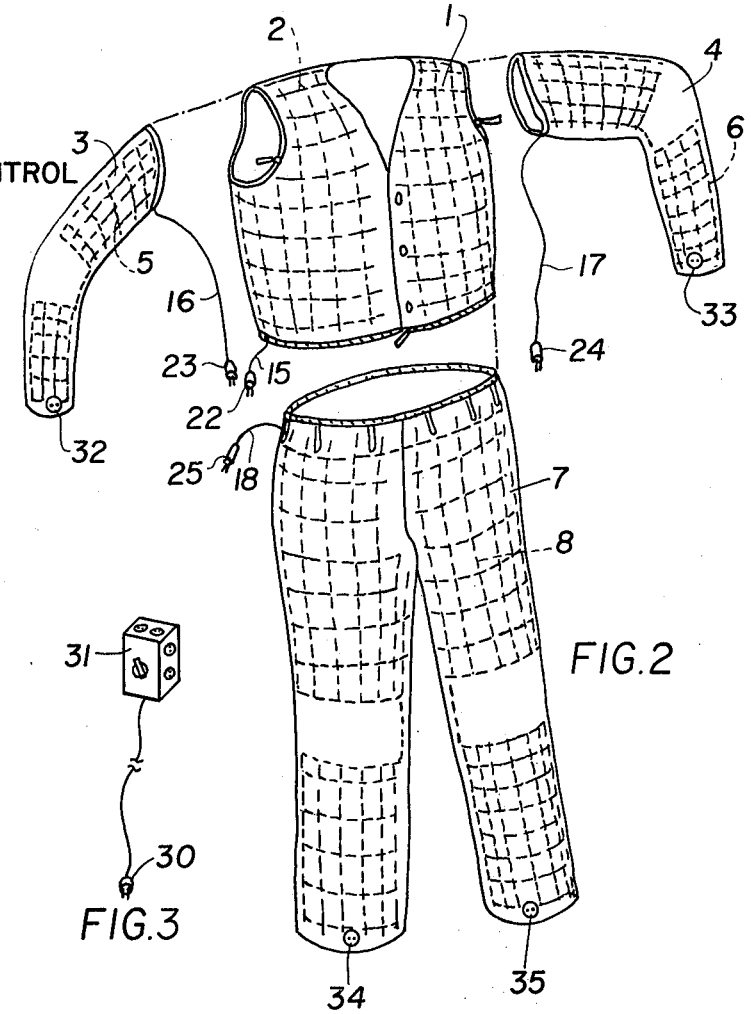
FIG.2
FIG.3
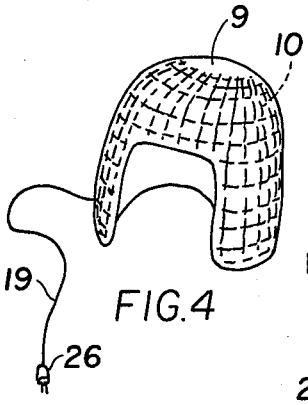
FIG.4
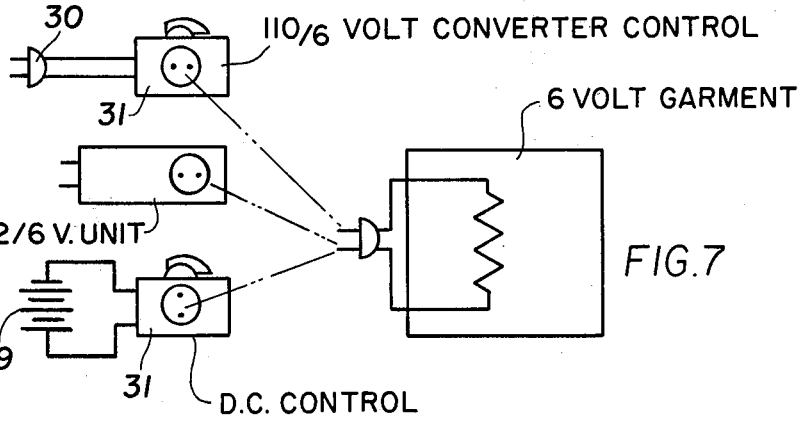
FIG.7
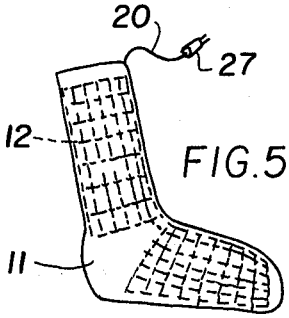
FIG.5
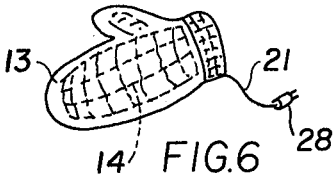
FIG.6

HEATED GARMENT

DESCRIPTION OF THE INVENTION

The present invention relates to a heated garment.

Objects of the invention are to provide a heated garment of simple structure, which is inexpensive in manufacture, and functions efficiently, effectively and reliably to provide electrically energized heat in a garment to keep a wearer of the garment warm in the most severe conditions of cold.

In order that the invention may be readily carried into effect, it will now be described with reference to the accompanying drawing, wherein:

FIG. 1 is a view of an embodiment of the garment of the invention on a wearer;

FIG. 2 is an exploded view of an embodiment of the vest type garment, the pair of sleeves, and the pair of pants of the heated garment of the invention;

FIG. 3 is a perspective view of an electrical connection box for the energy device of the invention;

FIG. 4 is a perspective view of an embodiment of the hat of the heated garment of the invention;

FIG. 5 is a view of a sock of the heated garment of the invention;

FIG. 6 is a view of a glove of the heated garment of the invention; and

FIG. 7 is a schematic circuit diagram of the energy device of the heated garment of the invention.

The heated garment of the invention comprises a vest type garment 1 (FIGS. 1 and 2) having a lining 2 consisting of an electrical heating element. In the embodiment of FIG. 1, the wearer is wearing the heated garment of the invention under an outer coverall-type garment. The electrical heating element is provided in any suitable meander, grid, or other type configuration to cover the entire area of the garment.

A pair of sleeves 3 and 4 are provided. Each of the sleeves has a lining, similar to that of the vest type garment 1, consisting of an electrical heating element 5 and 6, respectively (FIGS. 1 and 2).

A pair of pants 7 has a lining, similar to that of the vest type garment 1, consisting of an electrical heating element 8 (FIGS. 1 and 2).

A hat 9 has a lining, similar to that of the vest type garment 1, consisting of an electrical heating element 10 (FIG. 4).

A pair of socks are provided, one sock 11 of which is shown in FIG. 5. Each of the socks has a lining, similar to that of the vest type garment 1, consisting of an electrical heating element 12 (FIG. 5).

A pair of gloves are provided, one glove 13 of which is shown in FIG. 6. Each of the gloves has a lining, similar to that of the vest type garment 1, consisting of an electrical heating element 14 (FIG. 6).

An energy device, as shown in FIGS. 3 and 7, supplies electrical energy to the electrical heating element of each of the vest type garment 1, the sleeves 3 and 4, the pair of pants 7 and the hat 9 for energizing the electrical heating elements to provide heat. The energy device comprises a plurality of electrical conductors, each electrically connected to the electrical heating element of a corresponding one of the vest type garment, the pair of sleeves, the pair of pants, the hat, the pair of socks and the pair of gloves.

Thus, an electrical conductor 15 is electrically connected to the electrical heating element 2 of the vest type garment 1 (FIG. 1). An electrical conductor 16 is electrically connected to the electrical heating element 5 of the sleeve 3 (FIG. 1). An electrical conductor 17 is electrically connected to the electrical heating element 6 of the sleeve 4 (FIG. 1). An electrical conductor 18 is electrically connected to the electrical heating element 8 of the pants 7 (FIG. 1). An electrical conductor 19 is electrically connected to the electrical heating element 10 of the hat 9 (FIG. 4). An electrical conductor 20 is electrically connected to the electrical heating element 12 of the sock 11 (FIG. 5). An electrical conductor 21 is electrically connected to the electrical heating element 14 of the glove 13 (FIG. 6).

The energy device further comprises a plurality of electrically connective plugs 22, 23, 24, 25, 26, 27 and 28 connected to the electrical conductors 15, 16, 17, 18, 19, 20 and 21, respectively, for connection to a source of electrical energy. The source of electrical energy may comprise a battery 29 of any suitable type or a commercial power source which is tapped via an electrical connector plug 30 (FIG. 7). Each of the electrically connective plugs 23 to 26 is connected to the source of electrical energy 29 or 30 by insertion into a socket of the electrical connection box 31 (FIGS. 3 and 7).

An electrically connective socket 32 is electrically connected to the electrical heating element 5 of the sleeve 3 and is provided on said sleeve. An electrically connective socket 33 is electrically connected to the electrical heating element 6 of the sleeve 4 and is provided on said sleeve. The electrically connective sockets 32 and 33 accommodate the plugs of the gloves. An electrically connective socket 34 is electrically connected to the electrical heating element 8 of the pants 7 and is provided on one leg of said pants. An electrically connective socket 35 is also electrically connected to the electrical heating element 8 of the pants 7 and is provided on the other leg of said pants. The electrically connective sockets 34 and 35 accommodate the plugs of the socks.

While the invention has been described by means of a specific example and in a specific embodiment, I do not wish to be limited thereto, for obvious modifications will occur to those skilled in the art without departing from the spirit and scope of the invention.

I claim:

1. In a heated garment comprising a vest type garment having a lining consisting of an electrical heating element, a pair of sleeves each having a lining consisting of an electrical heating element, a pair of pants having a lining consisting of an electrical heating element, a hat having a lining consisting of an electrical heating element, a pair of socks each having a lining consisting of an electrical heating element and a pair of gloves each having a lining consisting of an electrical heating element, energy means for supplying electrical energy to the electrical heating element of each of the vest type garment, the pair of sleeves, the pair of pants and the hat for energizing said electrical heating elements to provide heat, said energy means comprising a plurality of electrically conductive means each electrically connected to the electrical heating element of a corresponding one of the vest type garment, the pair of sleeves, the pair of pants, the hat, the pair of socks and the pair of gloves, a plurality of electrically connective plugs each connected to a corresponding one of the conductive means for connection to a source of electrical energy and a plurality of electrically connective sockets each connected to the electrical heating element of a corresponding one of the sleeves and legs of the pants for accommodating the plugs of the gloves and socks.

* * * * *